US007031624B2

(12) United States Patent
Kobayashi et al.

(10) Patent No.: US 7,031,624 B2
(45) Date of Patent: Apr. 18, 2006

(54) IMAGE FORMATION APPARATUS FOR PROVIDING A PREDETERMINED TEMPERATURE LOWERING PERIOD IN WHICH THE TEMPERATURE OF A FIXING UNIT IS REDUCED

(75) Inventors: Shinsuke Kobayashi, Shizuoka (JP); Kenichi Ogawa, Shizuoka (JP); Hironori Kato, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 10/687,734

(22) Filed: Oct. 20, 2003

(65) Prior Publication Data

US 2004/0081478 A1 Apr. 29, 2004

(30) Foreign Application Priority Data

Oct. 21, 2002 (JP) ..... 2002-305572

(51) Int. Cl.
*G03G 15/00* (2006.01)
*G03G 15/20* (2006.01)

(52) U.S. Cl. ..... 399/44; 399/69

(58) Field of Classification Search ..... 399/44, 399/67, 69, 70, 320, 328, 329
See application file for complete search history.

(56) References Cited

U.S. PATENT DOCUMENTS

| | | | | | |
|---|---|---|---|---|---|
| 4,914,476 | A | * | 4/1990 | Nishitsuji et al. | 399/44 |
| 5,083,168 | A | | 1/1992 | Kusaka et al. | |
| 5,138,379 | A | * | 8/1992 | Kanazashi | 399/44 |
| 5,149,941 | A | | 9/1992 | Hirabayashi et al. | 219/216 |
| 5,162,634 | A | | 11/1992 | Kusaka et al. | 219/216 |
| 5,177,549 | A | * | 1/1993 | Ohtsuka et al. | 399/320 |
| 5,179,397 | A | | 1/1993 | Ohzeki et al. | |
| 5,210,579 | A | | 5/1993 | Setoriyama et al. | |
| 5,220,389 | A | * | 6/1993 | Kishimoto et al. | 399/69 |
| 5,253,022 | A | | 10/1993 | Takeuchi et al. | |
| 5,262,834 | A | | 11/1993 | Kusaka et al. | |
| 5,300,997 | A | | 4/1994 | Hirabayashi et al. | |
| 5,343,280 | A | | 8/1994 | Hirabayashi et al. | |
| 5,525,775 | A | | 6/1996 | Setoriyama et al. | 219/216 |
| 5,552,582 | A | | 9/1996 | Abe et al. | 219/619 |
| 5,767,484 | A | | 6/1998 | Hirabayashi et al. | 219/216 |
| 5,801,359 | A | * | 9/1998 | Mano et al. | 399/329 |
| 5,862,445 | A | | 1/1999 | Ogawa et al. | 399/329 |
| 6,389,241 | B1 | * | 5/2002 | Cernusak et al. | 399/44 |
| 6,389,247 | B1 | * | 5/2002 | Chung | 399/69 |
| 6,493,521 | B2 | * | 12/2002 | Miyamoto et al. | 399/44 |
| 6,654,570 | B2 | | 11/2003 | Kato | 399/66 |
| 2002/0118977 | A1 | * | 8/2002 | Hasegawa et al. | 399/69 |
| 2003/0002895 | A1 | | 1/2003 | Kato et al. | 399/333 |
| 2003/0044186 | A1 | | 3/2003 | Kato et al. | 399/16 |
| 2003/0077092 | A1 | | 4/2003 | Ogawa et al. | 399/328 |
| 2003/0184010 | A1 | | 10/2003 | Kato et al. | 271/207 |

FOREIGN PATENT DOCUMENTS

| | | |
|---|---|---|
| JP | 63-313182 | 12/1988 |
| JP | 2-157878 | 6/1990 |
| JP | 2-264278 | 10/1990 |
| JP | 4-44075 | 2/1992 |
| JP | 4-204980 | 7/1992 |
| JP | 7-281492 | 10/1995 |

* cited by examiner

*Primary Examiner*—Sandra L. Brase
(74) *Attorney, Agent, or Firm*—Fitzpatrick, Cella, Harper & Scinto

(57) ABSTRACT

A printer control unit starts operations related to next image information signals following a predetermined period required for executing post-processing operations after thermally fixing all toner images related to previous image information signals on recording mediums by a fixing device. Furthermore, the printer control unit sets a predetermined period required for executing post-processing operations based on information related to the environment in which the laser printer is situated. This arrangement prevents slippage of sheets at the fixing unit.

14 Claims, 9 Drawing Sheets

IMAGE FORMATION APPARATUS FOR PROVIDING A PREDETERMINED TEMPERATURE LOWERING PERIOD IN WHICH THE TEMPERATURE OF A FIXING UNIT IS REDUCED

BACKGROUND OF THE INVENTION

1. Field of the Invention

The present invention relates to an image formation apparatus.

2. Description of the Related Art

With image formation apparatuses (image recording apparatuses) employing image formation processing such as electrophotography, electrostatic recording, or the like, an electrostatic latent image is formed on a photosensitive drum or the like serving as an image carrying member, the electrostatic latent image is developed with a developing agent so as to visualize the image as a toner image, this toner image is transferred onto a recording medium such as a sheet, following which the recording medium on which the toner image is transferred is passed through a nip portion made up of a fixing roller and a pressure roller provided on a fixing device, thereby thermally fixing the toner image on the recording medium as a permanent image.

FIG. 13 is a schematic side view of primary parts illustrating an example of such a typical image formation apparatus. A photosensitive member 1 (hereafter, referred to as a "photosensitive drum") is disposed above the face of a sheet and rotates in an X direction shown with an arrow, and the surface thereof is uniformly charged by a charging roller 2 connected to a high-voltage power source 7, and a laser beam L modulated by image signals from a laser scanner 3 is cast onto the charged face thereof so as to form an electrostatic latent image. Toner 5 is supplied onto the latent image from a developing device 4 so as to form a toner image. The toner image reaches a transfer nip portion T.

The transfer portion T comprises a nip portion between the photosensitive drum 1 and an electroconductive transfer roller 6 in contact with the photosensitive drum 1. Synchronously with the timing of a toner image portion on the photosensitive drum 1 reaching the transfer portion T, a recording medium P is supplied and passed through the nip portion. At this time, a transfer bias is applied onto the transfer roller 6 by a power source 8, and the toner image on the photosensitive drum 1 side is transferred onto the recording medium P, following which the recording medium P holding a toner image leaves the transfer portion T and is transported to an unshown fixing device.

Recently, film-heating fixing devices have been proposed which employ a fixing method wherein power is not supplied to the fixing device in particular during a standby period, so as to suppress power consumption as much as possible (e.g., Japanese Patent Laid-Open Nos. 63-313182, 2-157878, 4-44075, and 4-204980).

The fixing device comprises a heater, a slidable thermostable film (fixing film), and a pressure member for forming a fixing nip portion by coming into contact with the heater across the film, and is a device for nipping a recording medium on which an unfixed image is formed between the film of the fixing nip portion and the pressure member so as to transport the recording member, and for fixing the unfixed image onto the recording medium as a permanent image by heat provided from the heater through the film and pressure force of the fixing nip portion.

With such a film-heating fixing device, a low-thermal-capacity linear heating member serving as a heater and a thin-low-capacity member serving as a film can be employed, thereby enabling power to be conserved and wait periods to be reduced (meaning quick starts).

With this type of film heating fixing device, there are two driving methods for the fixing film. One is a tension providing method wherein, while providing tension on the fixing film with a dedicated transporting roller and a dedicated driven roller, the fixing film is transported between the driven roller and a pressure roller serving as a pressure member. The other is a tensionless method wherein a cylindrical fixing film is driven with the transporting force of the pressure roller by rotating and driving the pressure roller serving as a pressure member. The former has an advantage of improving transportability of the fixing film, and the later has an advantage of realizing a low-cost device owing to simplification of the device configuration.

In recent years, demand for printers have increased with the development of the computer industry, so printers have come to be widely used worldwide. Thus, in accordance with sheets having various kinds of thickness and various surface properties, and speeding up of image formation apparatuses, satisfied fixability has been obtained by gradually increasing the momentary amount of heat which is provided to a recording medium from the heater so that the period required for printing the first sheet can be reduced and printing fixability of the first sheet can be ensured. Further, in recent years, in response to increased user requests for high quality images, printers with excellent performance in dot reproduction and gradients have been released, which enable high quality images to be printed by further reducing the grain diameter of toner serving as an image manifesting agent (a developing agent).

Moreover, with regard to transfer bias control for these types of image formation apparatuses, the ATVC method (Active Transfer Voltage Control) has already been proposed (for example, Japanese Patent Laid-Open No. 2-264278).

This method is a way to optimize a transfer bias applied onto the transfer roller 6 at a transfer period, and optimizes the transfer bias with an arrangement wherein a desired constant current bias is applied onto the photosensitive drum 1 from the transfer roller 6 during the initial rotation of the image formation apparatus, the resistance of the transfer roller is detected from a detected voltage Vo at that time, and the constant voltage bias corresponding to the resistance is selected in a transfer period. In this case, the transfer voltage Vt is represented by the following expression (ATVC expression).

$$Vt=AVo+B \text{ (wherein } A \text{ and } B \text{ are constants)}$$

With a contact transfer method, the optimal voltage to be applied at the leading edge of a recording medium changes depending on the resistance of the transfer roller. Moreover, the transfer roller has irregularities in resistance over a wide range, and the properties of the recording medium drastically change from high-temperature and high-humidity (H/H) environments to low-temperature and low-humidity (L/L) environments. Taking advantage of these properties allows the apparatus to distinguish H/H environments from L/L environments based on the resistance of the transfer roller, and also enables the same transfer performance to be maintained by the transfer roller even if environmental variations occur.

The Vt is calculated from Vo obtained at the initial rotation in order to prevent developing on the leading edge of a recording medium from a substandard transfer current such as an explosive image.

SUMMARY OF THE INVENTION

Accordingly, it is an object of the present invention to provide an improved image formation apparatus, capable of solving the above-described problems.

To this end, according to a first aspect of the present invention, an image formation apparatus comprises: a charging unit for charging an image carrying member to a predetermined potential; an exposure unit for exposing the image carrying member in order to form an electrostatic latent image corresponding to image information signals from an external device onto the image carrying member charged by the charging unit; a developing unit for developing the electrostatic latent image on the image carrying member with a developing agent to form a developing agent image; a transfer unit for applying a transfer voltage onto a transfer member to transfer the developing agent image on the image carrying member onto a recording medium; a fixing unit comprising a heating member for thermally fixing the developing agent image onto the recording medium on which the developing agent image is transferred by the transfer unit, and a pressure member for transporting the recording member while pressing the recording member against the heating member; an output unit for outputting information related to the environment in which the image formation apparatus is disposed; and a control unit for providing a predetermined lowering period of temperature for reducing temperature at the fixing unit between a fixing operation for a recording medium on which a developing agent image corresponding to previous image information signals is transferred and a fixing operation for a recording medium on which a developing agent image corresponding to next image information signals has been transferred; wherein the control unit sets the predetermined lowering period of temperature based on information related to the environment which the detecting unit detects.

Further objects, features and advantages of the present invention will become apparent from the following description of the preferred embodiments with reference to the attached drawings.

DESCRIPTION OF THE PREFERRED EMBODIMENTS

First Embodiment

The following description will be made regarding a first embodiment according to the present invention with reference to appended drawings.

Figure 2:
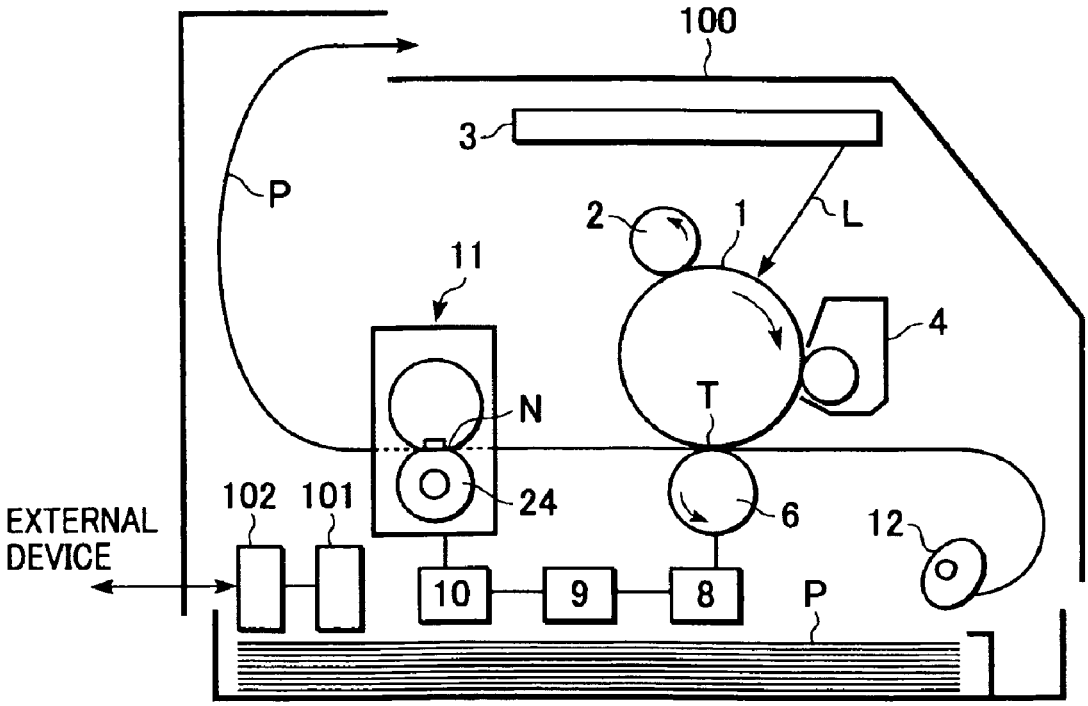
FIG. 2 is a schematic configuration diagram of a laser beam printer 100.

FIG. 2 is a schematic diagram illustrating the configuration of an electrophotography laser beam printer 100 according to the first embodiment. In FIG. 2, reference numeral 101 denotes a printer control unit for controlling each part of the laser beam printer 100 to form an image on a sheet P. Reference numeral 102 denotes an image processing control unit for receiving image information signals to be printed from an external device such as a host computer or the like, and also for performing processing to convert the received image information signals to image signals capable of being formed at the laser beam printer 100. Moreover, the image processing control unit 102 transmits image signals to the printer control unit 101, and also transmits instructions such as printing start instructions and so forth.

Reference numeral 3 denotes a laser scanner. The printer control unit 101 modulates the intensity of a laser beam L cast onto a photosensitive drum 1 by the laser scanner 3 based on the image information signals sent to the laser beam printer 100 from an external device such as a host computer.

The surface of the photosensitive drum 1 on which the laser scanner 3 exposes the laser beam L, is charged to a uniform potential by a charging roller 2, on which an electrostatic latent image is formed by the laser beam L cast onto the photosensitive drum 1.

The electrostatic latent image is transported, following the rotation of an arrow direction of the photosensitive drum 1, to a portion on which a developing device 4 faces the photosensitive drum 1, and is consecutively developed with toner serving as a developing agent by the developing device 4.

Subsequently, the printer control unit 101 consecutively transfers the developed toner image by the developing device 4 onto the sheet P serving as a recording medium, sent to a transfer nip portion T with an ion electroconductive transfer roller 6 from a sheet feeding device 12 serving as supply means for recording mediums.

The transfer roller 6 has an elastic layer of ion electroconductive NBR (nitrile-butadiene rubber) formed on an iron core 6 mm in diameter, and is 15 mm in diameter and has a hardness of 45° (under pressure of Asker-C 500 g). Resistance is set to $8\times10^8$ Ω by compound adjustment of NBR. Ion electroconductive solid rubber has properties wherein the resistance thereof markedly changes depending on the environment to which the laser beam printer 100 is exposed, and accordingly can be used as sort of an environment sensor for detecting the environment in which the laser beam printer 100 is.

Reference numeral 8 denotes a DC high-voltage generator (transfer high-voltage generator) serving as a transfer voltage application portion for generating a transfer voltage to be applied to the transfer roller 6, and 9 denotes a transfer high-voltage control portion for controlling the DC high-voltage generator 8. The printer control unit 101 separates the sheet P on which the toner image is transferred at the transfer nip portion T following the rotation of the photosensitive drum 1, and also transports the sheet P to a fixing device 11.

Figure 3:
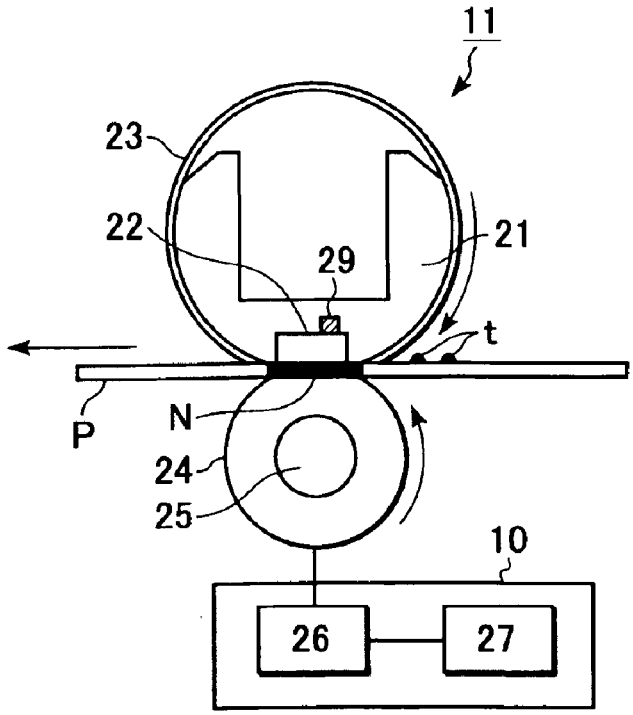
FIG. 3 is a cross-sectional diagram of a fixing device 11.

Next, the configuration of the fixing device 11 will be described. The fixing device 11 is a film heating, pressure rotor driving, so-called tensionless type fixing device. FIG. 3 is a cross-sectional view of the fixing device 11.

The fixing device 11 comprises a film in-plane guide member 21 having thermostability and stiffness, and a heater 22 for generating heat, which is fitted into a concave groove portion provided at the bottom of the film in-plane guide member 21 in the longitudinal direction of the film in-plane guide member 21 and fixed. A ceramic heater or the like is employed as the heater 22, for example.

With the film in-plane guide member 21 in which the heater 22 is fitted, a cylindrical fixing film 23 made of thermostable resin with an outer circumferential length of around 57 mm is fitted in externally, without tension. The fixing film 23 is, for example, a film made of thermostable resin such as polyimide or the like. The inner circumferential length of the fixing film 23 is longer than the outer circumferential length of the film in-plane guide member 21 including the heater 22 by 3 mm, and the film 23 is externally fitted to the film in-plane guide member 21 including the heater 22 without tension.

Furthermore, the fixing device 11 includes a pressure roller 24. The pressure roller 24 (contact roller, driving roller) serves as a pressurizing rotating member, with the film 23 being nipped between the pressure roller 24 and the film in-plane guide member 21 including the heater 22. The pressure roller 24 is a rotating member comprising a core 25, and thermostable rubber such as silicone rubber, fluorine rubber, or the like, formed integrally with concentricity on the core, or an elastic layer formed by foaming silicone rubber or the like. The pressure roller 24 is disposed with both end portions of the core 25 capable of being rotated, and borne between the front side panel of the device chassis and the back side panel thereof by a bearing member. The pressure roller 24 and the film in-plane guide member 21 are fixed so as to come in contact with each other, and form a fixing nip portion N.

The pressure roller 24 is rotated and driven at a predetermined peripheral velocity by a rotating control unit 10 controlled by the printer control unit 101. The rotating force is provided on the cylindrical film 23 by the contact frictional force in the fixing nip portion N made up of the pressure roller 24 and the film 23 rotated and driven by the pressure roller 24, so the film 23 is rotated by being driven on the outer circumference of the film in-plane guide member 21 with the inner side of the film 23 in contact with and sliding over the bottom of the heater 22. The rotating control unit 10 comprises a motor 26 for rotating and driving the pressure roller 24, and a CPU 27 for controlling the rotation of the motor 26.

The printer control unit 101 rotates and drives the pressure roller 24, whereby the cylindrical film 23 is also rotationally driven. The printer control unit 101 turns on the heater 22, and introduces the recording medium P, on which an unfixed toner image t is held, between the film 23 of the fixing nip portion N and the pressure roller 24 in a state wherein the temperature of the heater 22 rises and is initially controlled to a predetermined temperature.

The printer control unit 101 controls the fixing nip portion N to nip and transport the recording medium P along with the film 23, bringing the toner image carrying side of the recording medium P into contact with the outer face of the film 23 at the fixing nip portion N. In this processing, the heat of the heater 22 is provided to the sheet P (the recording medium P) through the film 23, and the unfixed toner image t on the sheet P is fused and fixed by being heated and pressed on the sheet P. Note that the sheet P which has passed through the fixing nip portion N is separated from the film 23 by the curvature thereof.

Next, image formation operations with the laser beam printer 100 will be described. The image formation operations comprise standby operation, initial rotating operation, image forming operation, and post-processing operation.

(Standby Operation)

The printer control unit 101 controls an unshown main motor to be driven so as to rotate the photosensitive drum 1, upon the laser beam printer 100 being turned on. The printer control unit 101 applies a predetermined high voltage to the charging roller 2 to stabilize the surface potential of the photosensitive drum 1 to a predetermined potential (hereafter referred to as "standby operation") so that the laser beam printer 100 can form an image on the sheet P. Upon the standby operation being completed, the laser beam printer 100 is in a predetermined idle state.

(Initial Rotating Operation)

Next, responding to the image information signals being received from an external device such as a host computer or the like, the printer control unit 101 executes operation for changing the laser beam printer 100 from the idle state to a state for forming an image on the sheet P (hereafter, referred to as "initial rotating operation"). The initial rotating operation is executed following receiving the image information signals to the printer control unit 101 from the image processing control unit 102 during the standby operation.

The printer control unit 101 controls the photosensitive drum 1 so as to stop being rotationally driven by temporarily stopping driving of the main motor during periods when image information signals are not input following the standby operation being completed.

Note that the printer control unit 101 controls the laser beam printer 100 to be in a predetermined standby state until image information signals are input. The printer control unit 101 executes the initial rotating operation, that is, driving rotation including the pressure roller of the fixing device 11, corresponding to image information signals being received.

The printer control unit 101 starts power supply to the heater 22 of the fixing device 11 as the initial rotating operation. Here, in the event that the information specifying the type of the sheet P is not included in the image information signals from an external device such as a host computer or the like, the printer control unit 101 controls the fixing temperature of the heater of the fixing device 11 so as to be 165° C. in the normal mode.

A transfer high voltage control unit 9 controls a transfer high-voltage generator 8 so that constant current of 4 μA flows into the transfer roller 6. Note that the laser beam printer 100 comprises an unshown transfer current detecting unit for detecting the transfer current value flowing into the transfer roller 6.

The printer control unit 101 detects the transfer voltage value Vo applied to the transfer roller 6 by the transfer high-voltage generator 8 when the transfer current value is 4 μA, which is so-called ATVC control. The transfer voltage value Vo is a voltage value corresponding to the environment in which the laser beam printer 100 is situated, and the transfer application voltage Vt applied to the transfer roller 6 by the transfer high-voltage generator 8 is calculated based on the transfer voltage Vo in the event of the sheet P passing through the transfer nip portion T.

With the first embodiment, the transfer voltage Vt is calculated from the transfer voltage Vo using the following Expression 1.

$$Vt=2.2Vo+0.8 \quad (1)$$

(Image Forming Operation)

Upon the above-described initial rotating operation being completed, the image forming operation for forming a toner image on the photosensitive drum 1 is executed, and also transfer of the toner image formed on the photosensitive drum 1 to the sheet P is executed, following which the toner image on the sheet P is subjected to fixing processing by the fixing device 11, and the sheet P on which the toner image is formed is discharged.

Note that in the event of successively forming images on multiple pages on the sheets P in the image forming operation, the above-described operation is repeated for the number of printouts set beforehand.

In the event of successively forming images on multiple pages on the sheets P, the period from the trailing edge of the sheet P passing through the transfer nip portion T to the leading edge of the next sheet P reaching the transfer nip portion T is a period wherein there is no sheet P at the transfer nip portion T.

(Post-processing Operation)

Upon the image forming operation regarding the final image according to the image information signals input from the external device being completed, the post-processing operation serving as an end operation for changing to the predetermined standby state again is executed.

More specifically, the printer control unit 101 continuously rotates and drives the main motor for a certain period following the fixing operation regarding the final page of the image information signals according to one printing job being completed, and also stabilizes the surface potential of the photosensitive drum 1 to a predetermined potential by applying a predetermined high voltage onto the charging roller 2. At this time, the image forming operation has already been completed, so the printer control unit 101 does not supply power to the heater of the fixing device 11, which is off.

Note that the fixing operation is an operation for thermally fixing a toner image on the sheet P onto the sheet P by supplying power to the heater 22 in the event of the sheet P passing through the fixing device 11, and transition from the fixing operation to the post-processing operation is executed in accordance with the trailing edge of the sheet P of the final page of the image information signals according to one printing job passing through the fixing nip portion N.

Upon the above-described post-processing operation having been completed, the printer control unit 101 stops driving of the main motor so as to stop rotational driving of the photosensitive drum 1, and continues a predetermined standby state until the next image information signals are input to the image processing control unit 102.

In the event of forming an image on one sheet P alone, the printer control unit 101 executes the post-processing operation following the image forming operation as to the one sheet P completed, and also sets the laser beam printer 100 to a standby state. Upon image information signals being input to the image processing control unit 102 in the standby state, the printer control unit 101 executes the initial rotating operation.

However, the laser beam printer 100 for performing the above-described operation has the following problems. As shown in FIG. 3, the fixing device 11 of the laser beam printer 100 performs temperature control by the heater 22 in order to fix a toner image on the sheet P in a stable manner. In detail, the printer control unit 101 controls temperature based on change in the resistance of a thermistor 29 depending on the temperature of the heater 22, but the heater 22 and the thermistor 29 are provided within the film 23, and neither the heater 22 nor the thermistor 29 are provided within the pressure roller 24.

Accordingly, the temperature which the thermistor 29 detects does not always match the temperature of the pressure roller 24 even if the temperature of the heater 22 is constant. For example, the temperature of the pressure roller 24 varies due to the size, thickness, and absorption properties of the sheets P, and the transportation intervals of the multiple sheets P.

The surface layer of the pressure roller 24 is made up of a PFA tube or the like, the transporting force for carrying the sheets P decreases due to the properties of the quality of material if the temperature at the pressure roller 24 reaches a certain temperature, resulting in a problem wherein slip-jamming (hereafter, referred to as "slipping") between the pressure roller 24 and the sheet P occurs.

Here, the term "slip" means a phenomenon wherein the sheet P existing between the pressure roller 24 and the film 23 is not driven by the rotation of the pressure roller 24, and slips therebetween, in an arrangement wherein the sheet P (a recording medium) on which an unfixed image is formed is transported to the fixing nip portion N within the fixing device 11 employing a fixing method wherein the pressure roller 24 is driven by the motor 26, and the film 23 is driven by the rotation of the pressure roller 24.

In general, the conditions of sheets P tending to slip are sheets having a moisture content ratio of 8.0% or more and a basic weight of 70 g/m$^2$ or less, left standing under an H/H environment.

Figure 4:
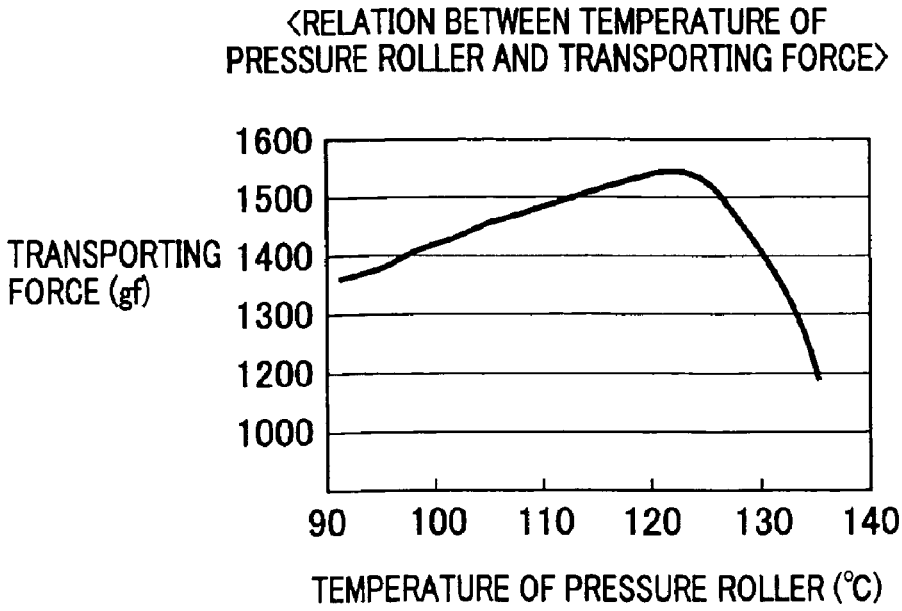
FIG. 4 is a graph illustrating the relation between temperature of a pressure roller and transporting force.

FIG. 4 is a graph illustrating the relation between the surface temperature of the pressure roller 24 and the transporting force (gf) which the pressure roller 24 provides onto the sheets P. As can be seen from FIG. 4, the transporting force which the pressure roller 24 provides to the sheets P drastically drops when the surface temperature of the pressure roller 24 exceeds 125° C.

Here, the term "the surface temperature of the pressure roller 24" means the temperature at the moment of the leading edge of the sheet P reaching the fixing nip portion N. Upon the sheet P which has a high moisture content ratio under an H/H environment reaching the pressure roller 24, the moisture of the sheet P is evaporated, and a steam layer is formed between the sheet P and the pressure roller 24, thereby decreasing transporting force which the pressure roller 24 provides to the sheet P, leading to a state wherein slippage between the sheet P and the pressure roller 24 tends to occur.

Note that the resistance of the pressure roller 24 characteristically becomes lower in an H/H environment than in a L/L environment, so that the environment in which the laser beam printer 100 is situated can be assumed from the transfer voltage applied to the transfer roller 6 so as to apply a constant current.

Figure 1:
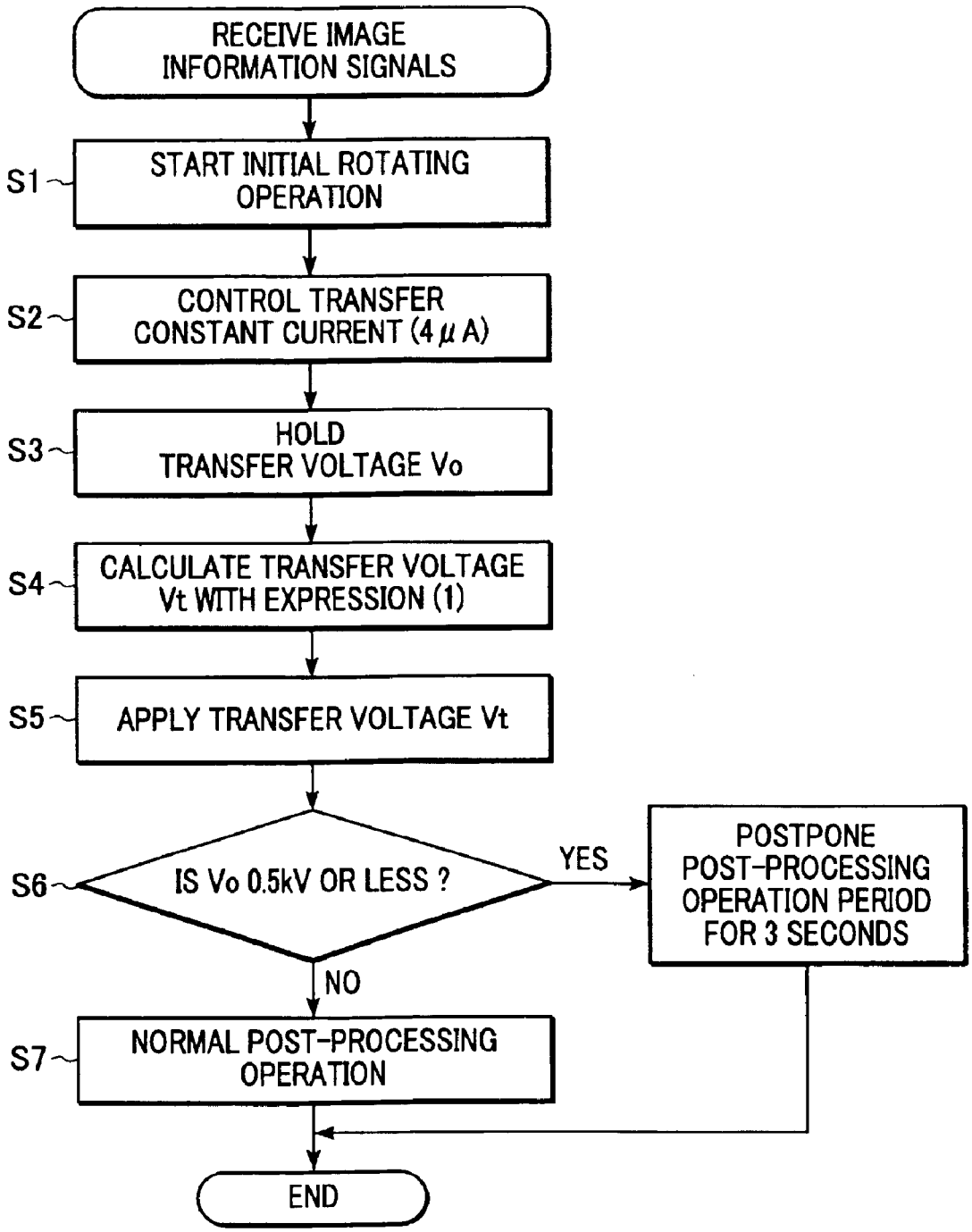
FIG. 1 is a flowchart of anti-slip control according to a first embodiment.

Operations according to the first embodiment will be described with reference to FIG. 1 in order to solve the foregoing slipping problem. FIG. 1 is a diagram illustrating a flowchart of the anti-slip control according to the first embodiment. FIG. 1 illustrates a control method wherein the pressure roller 24 is cooled down in a short period by extending the period required for the post-processing operation in the event of determining that the environment in which the laser beam printer 100 is disposed is an H/H environment in a case of detecting the transfer voltage Vo during the standby operation in order to perform ATVC control. Details of the flowchart will be described below.

In FIG. 1, upon the image processing control unit 102 receiving image information signals from an external device such as a host computer or the like, the printer control unit 101 executes the initial rotating operation (Step S1). Here, the printer control unit 101 sets the fixing temperature in the normal mode to 165° C. regarding the temperature control of the heater 22 within the fixing device 11 in a case that the information specifying the type of the sheet P is not included in the image information signals from an external device such as a host computer or the like.

Next, upon charging to the photosensitive drum 1 by the charging roller 2 being completed, the printer control unit 101 performs constant current control of 4 μA for ATVC control in a state wherein the photosensitive drum 1 is in contact with the transfer roller 6 at the transfer nip portion T. At this time, the printer control unit 101 detects, via the transfer high voltage control unit 9, the transfer voltage Vo applied to the transfer roller 6 by the transfer high-voltage generator 8 (Step S2).

Subsequently, the printer control unit 101 holds in the CPU 27 the value of the transfer voltage Vo, in the event of the transfer current of 4 μA flowing to the transfer roller 6 (Step S3).

Subsequently, the printer control unit 101 calculates the transfer voltage Vt based on the transfer voltage Vo and Expression 1 (Step S4).

Subsequently, the printer control unit 101 performs constant voltage control for applying the transfer voltage Vt to the transfer nip portion T at the time of the sheet P passing thereby (Step S5).

In the subsequent Step S6, the printer control unit 101 determines whether or not the previously held transfer voltage Vo is greater than 0.5 kV. The printer control unit 101 performs normal 5-second post-processing operations as end operations in a case of Vo exceeding 0.5 kV, and performs special 8-second post-processing operations including an extended 3 seconds in a case of Vo being 0.5 kV or less (Step S7). The printer control unit 101 does not start image formation on the pages according to image information signals to be printed next when performing the post-processing operation even if the image processing control unit 102 receives image information signals to be printed next from the external device, so the heater 22 is not turned on for at least 8 seconds in a case of Vo being 0.5 kV or less, thereby preventing the surface temperature of the pressure roller 24 from rising to a certain temperature which causes slipping.

Note that though the period required for the post-processing operation differs depending on the results of the determination, that is, Yes or No in Step S6, the printer control unit 101 turns off the heater 22 in the fixing device 11 in either case.

As described above, the printer control unit 101 can cool down the surface temperature of the pressure roller 24 in a shorter period after the sheet P passing through the pressure roller 24 in the event of the sheet P passing through the pressure roller 24 in an H/H environment in which the laser beam printer 100 is situated, so that the pressure roller 24 is not excessively heated even if next image information signals are received immediately after the previous sheet passes through the pressure roller 24. Thus, the transporting force which the pressure roller 24 provides to the sheets P can be prevented from decreasing, consequently preventing the slippage phenomenon from occurring.

Figure 5:
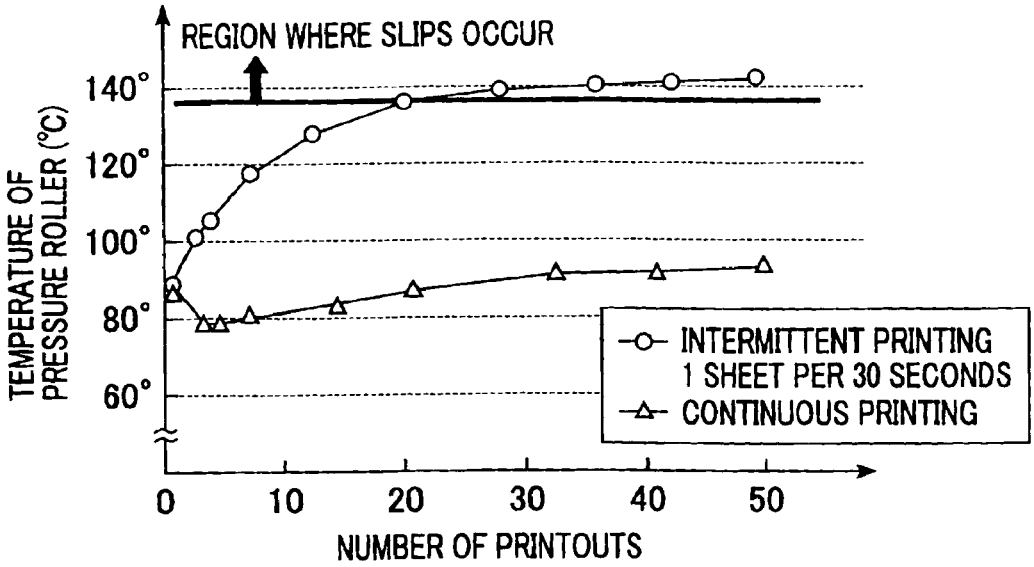
FIG. 5 is a graph illustrating temperature differences of the pressure roller during printing.

Here, how slipping occurs with the first embodiment, according to the surface temperature of the pressure roller 24 changing during intermittent printing, has been confirmed with an LBP121, manufactured by Canon Kabushiki Kaisha, which has a printing speed of 14 A4-size sheets per minute. With the first embodiment, the operation to start image formation is performed for 100 sheets P (circles shown in FIG. 5) following the post-processing operation for the preceding sheet P being completed and then 30 seconds elapsing in order to compare the conditions in which the surface temperature of the pressure roller 24 is apt to rise with the first embodiment. Compared with intermittent image formation (wherein sheets P are passed through with an interval exceeding a predetermined period), continuously printing the 100 sheets P without executing the post-processing operation prevents the pressure roller 24 from heating, and also prevents vapor from coming up, consequently preventing slipping from occurring.

Figure 6:
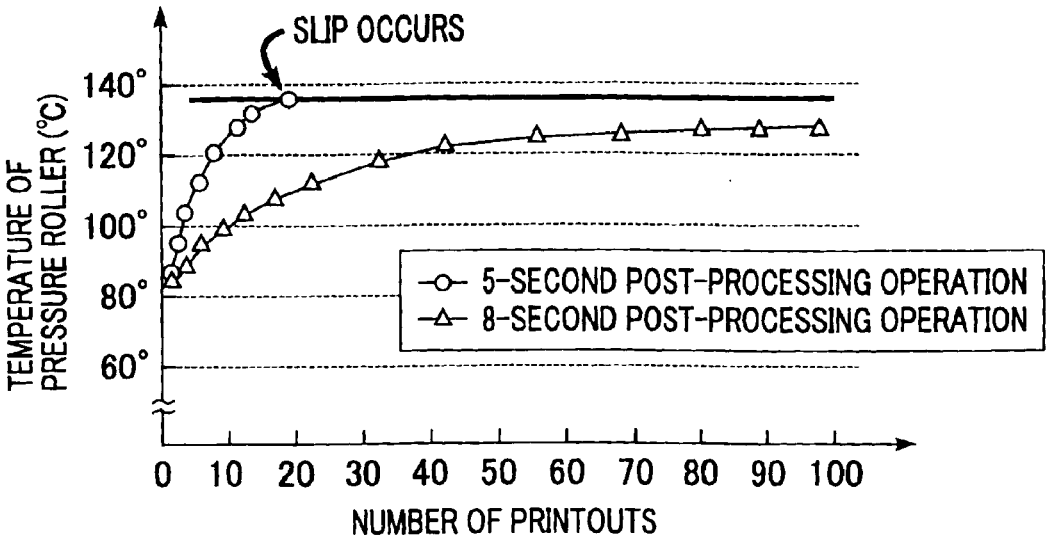
FIG. 6 shows results of a cold-start according to the first embodiment.

The relation between the number of printouts and the temperature of the pressure roller 24 is shown in FIG. 6 in the event of cold-starting for image formation in a state wherein the pressure roller 24 has not been warmed. The relation between number of printouts and the temperature of the pressure roller 24 is shown in FIG. 7 in the event of hot-starting for image formation in a state wherein the pressure roller 24 has been warmed.

Figure 7:
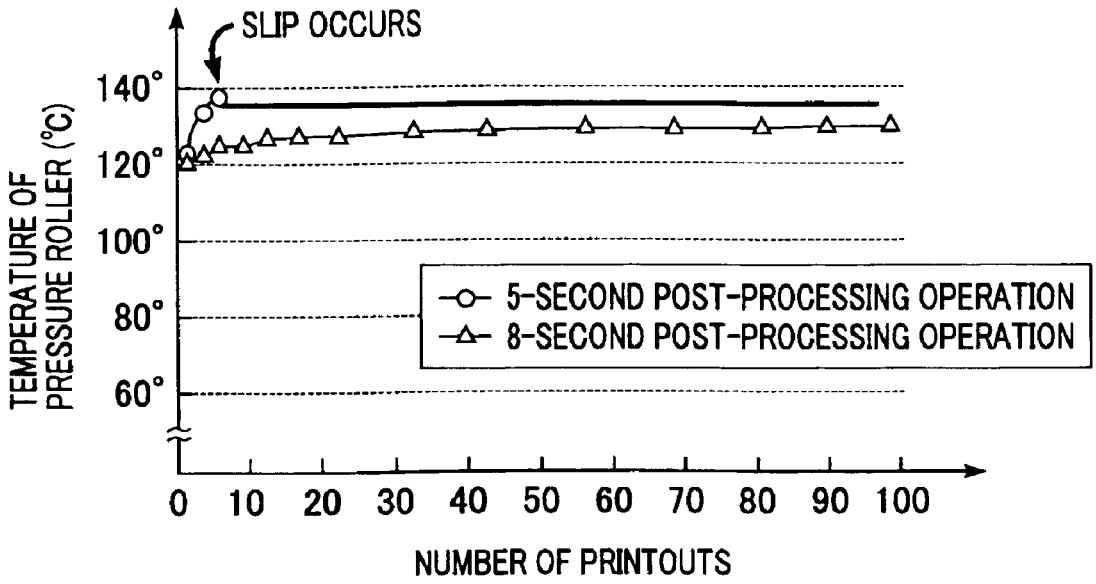
FIG. 7 shows results of a hot-start according to the first embodiment.

In FIGS. 6 and 7, upon printing processing for one sheet P having been completed, the post-processing operation is executed, following which 30 seconds later, printing the next sheet P starts.

In the case of cold-starting in FIG. 6, in the event that the period required for the post-processing operation was 5 seconds (circles shown in FIG. 6), slipping occurred at the 20th sheet fed, and the surface temperature of the pressure roller was around 135° C. However, in the event that the printer control unit 101 determined Yes in Step S6 in FIG. 1, and then the period required for the post-processing operation was extended from the normal 5 seconds to 8 seconds, the surface temperature of the pressure roller did not reach 130° C. even after 100 sheets were fed, and no slipping occurred.

In the case of hot-starting in FIG. 7, in the event that the period required for the post-processing operation was 5 seconds (circles shown in FIG. 6), slipping occurred at the second or third sheet fed, and the surface temperature of the pressure roller exceeded 135° C. However, in the event that the printer control unit 101 determined Yes in Step S6 in FIG. 1, and then the period required for the post-processing operation was extended from the normal 5 seconds to 8 seconds, the surface temperature of the pressure roller did not reach 130° C. even after 100 sheets were fed, and no slipping occurred.

As described above, in the event that intermittent printing with an arrangement wherein the next image information signals are input to the image processing control unit 102 from the external device immediately after the post-processing operation is completed under an H/H environment (intermittent printing within 30 seconds in the first embodiment) is continuously performed, and the pressure roller 24 is sufficiently warmed owing to heat during intermittent printing, extending the period required for the post-processing operation prevents the pressure roller 24 from excessively rising in temperature, thereby preventing the transporting force which the pressure roller 24 provides to the sheet P from decreasing, consequently preventing slipping from occurring. Here, with the first embodiment, while the threshold value of Vo is 0.5 kV, and extended period of the post-processing operation is 3 seconds, these values can be appropriately changed depending on the performance of the laser beam printer 100 such as printing speed, controlled temperature, and so forth.

Second Embodiment

Figure 8:
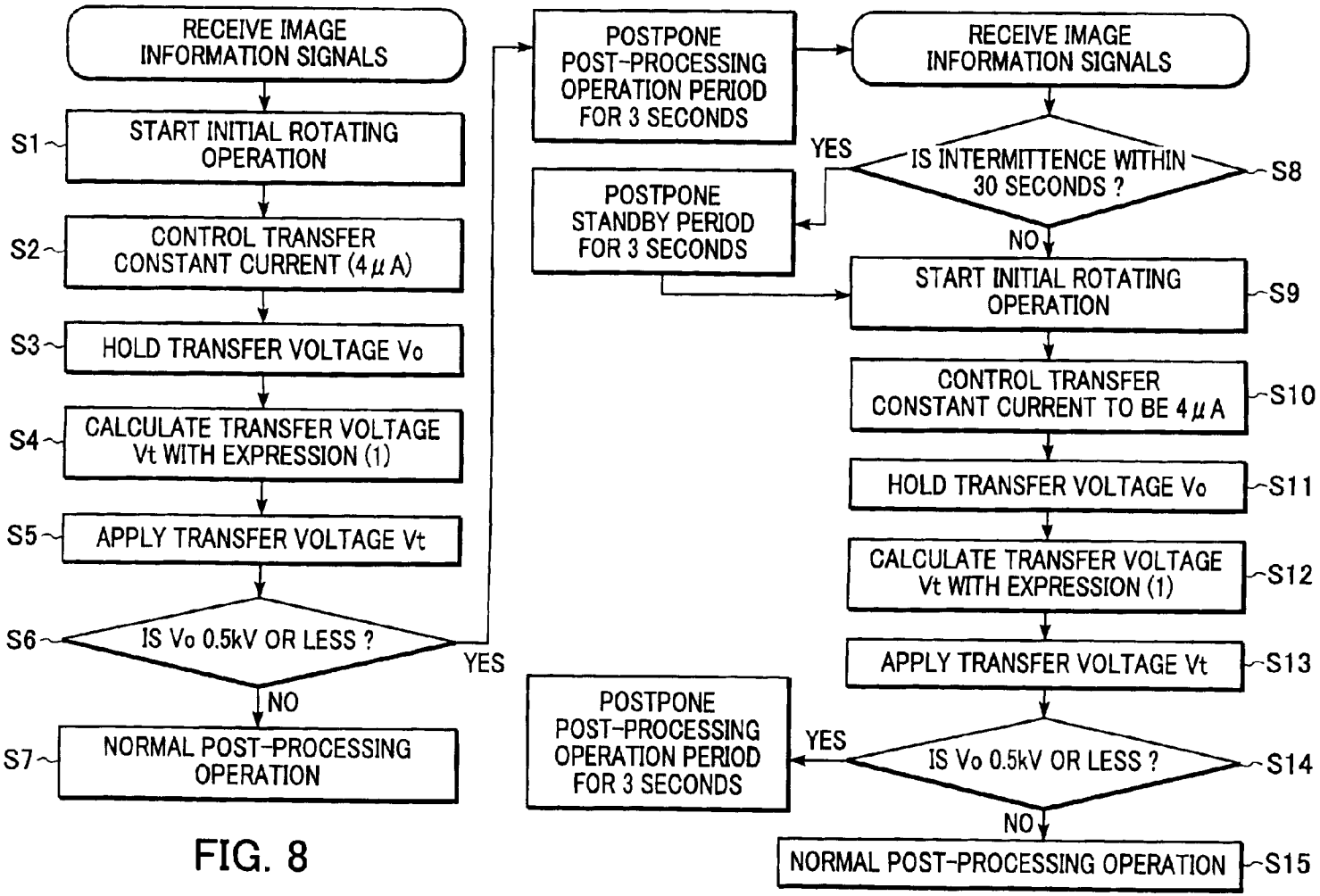
FIG. 8 is a flowchart of anti-slip control according to a second embodiment.

Next, operations to solve the slippage problem according to a second embodiment will be described with reference to FIG. 8. FIG. 8 illustrates a control method wherein extending the standby period up to starting image formation according to the next printing signals prevents the pressure roller 24 from being excessively warmed in the event that an H/H environment is determined by detecting the resistance of the transfer roller 6 as with the first embodiment, and the image forming operation is performed, following which the post-processing operation is performed, and after the post-processing operation being completed, the next printing signals are received within 30 seconds. A detailed flowchart will be described below.

In FIG. 8, the operations of Steps S1 through S7 are the same operations as those in FIG. 1 of the first embodiment. With the second embodiment, in Step S3, in the event that Vo held in the CPU 27 is 0.5 kV or less, and also in the event that the next printing signals are received within 30 seconds after the post-processing operation is completed (Step S8), a standby period of 3 seconds is provided instead of the normal operation in which the heater 22 is turned on immediately after receiving the printing signals, following which the initial rotating operation of the next Step S9 is performed, and then Steps S11, S12, S13, S14, and S15 are performed. Step S9 and Steps S11, S12, S13, S14, and S15, are the same printing operation steps as the previous printing operation steps. Thus, Steps S9, S11, S12, S13, S14, and S15 correspond respectively to Steps S1, S3, S4, S5, S6, and S7. In the event of the intermittence period being 30 seconds or more, the initial rotating operation of the next Step S9 is performed immediately.

In the event of continuous sheet feeding, printing operations according to the next image information signals are performed without performing the post-processing operation, so that there is no standby period. Accordingly, though control of extending a standby period is not performed, the pressure roller 24 is not excessively warmed in the event of continuous sheet feeding as described above, consequently preventing slipping from occurring.

As described above, in the event of continuously performing intermittent sheet feeding with intermittence periods of 30 seconds or less in an H/H environment, extending the standby period prevents the surface temperature of the pressure roller 24 from excessively rising, thereby preventing the transporting force which the pressure roller 24 provides to the sheets P from decreasing, consequently preventing slipping from occurring.

Now, how slippage occurs according to the surface temperature of the pressure roller 24 changing during intermittent printing has been confirmed with the same laser beam printer 100 as that in the first embodiment, in the event of the period required for the post-processing operation being 5 seconds, in the event of the period required for the post-processing operation being 8 seconds in the first embodiment, and in the event of the standby period being 3 seconds in the second embodiment, respectively. With the second embodiment, intermittent sheet feeding with intermittence periods of 15 seconds or less is performed for 100 sheets, as conditions under which the temperature of the pressure roller 24 is apt to rise. Performing intermittent sheet feeding within 15 second periods means that the initial rotating operation according to the next image information signals starts immediately after the post-processing operation of printing according to the previous image information signals, so there is almost no cooling period for the inner portions of the laser beam printer 100 including the pressure roller 24, and accordingly, these are the most severe conditions for the laser beam printer 100 employed in the second embodiment.

Figure 9:
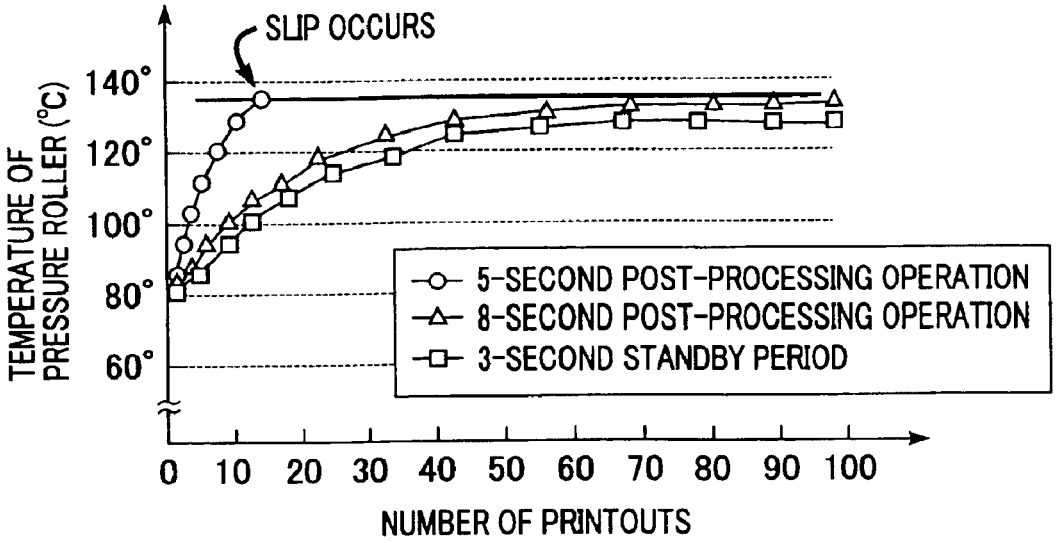
FIG. 9 shows results of a cold-start according to the second embodiment.
Figure 10:
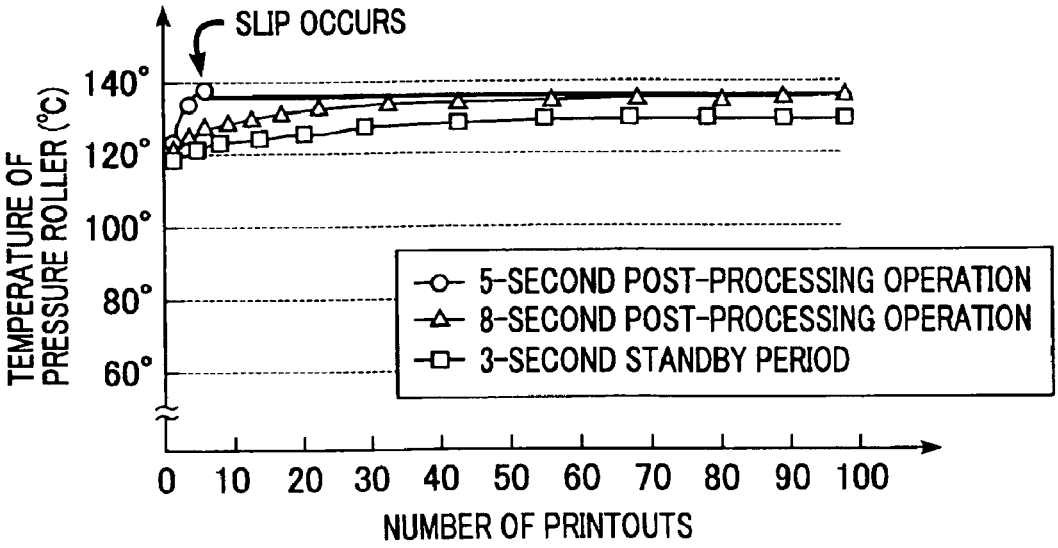
FIG. 10 shows results of a hot-start according to the second embodiment.

The measurement results of cold-starting are shown in FIG. 9, and the measurement results of hot-starting with the pressure roller 24 having been warmed are shown in FIG. 10.

With the cold-starting shown in FIG. 9, slipping occurred at the 15th sheet fed, with the surface temperature of the pressure roller 24 being around 135° C. in the event of the period required for the post-processing operation being 5 seconds. With the control method in the first embodiment, though slipping did not occur, the temperature of the pressure roller 24 reached near 135° C. which is the threshold value temperature for slippage at the 100th sheet. However, with the control method in the second embodiment, the surface temperature of the pressure roller 24 stays below 130° C. even after 100 sheets are fed by providing a standby period of 3 seconds, and slipping did not occur.

With the hot-starting shown in FIG. 10, the surface temperature of the pressure roller 24 exceeded 135° C. at the second sheet fed and slipping occurred in the event of the period required for the post-processing operation being 5 seconds. With the control method in the first embodiment, though slipping did not occur, the temperature of the pressure roller 24 reached near 135° C. which is the threshold value temperature for slipping at the 100th sheet fed. However, with the control method in the second embodiment, the surface temperature of the pressure roller 24 stays below 130° C. even after 100 sheets fed by providing a standby period of 3 seconds, and slipping did not occur.

As described above, in the event that intermittent printing is continuously performed with an arrangement wherein the next image information signals are input to the image processing control unit 102 from the external device immediately after the post-processing operation being completed in an H/H environment (intermittent printing within 15 seconds in the second embodiment), and the pressure roller 24 is sufficiently warmed owing to heat during intermittent printing, extending the period required for the post-processing operation and further extending the standby period up to the next printing prevents the pressure roller 24 from excessively rising in temperature, thereby preventing the transporting force which the pressure roller 24 provides to the sheet P from decreasing, consequently preventing slipping from occurring. Here, with the second embodiment, while the standby extended period is 3 seconds, this can be appropriately changed depending on the performance of the laser beam printer 100 such as printing speed, controlled temperature, and so forth.

Third Embodiment

Figure 11:
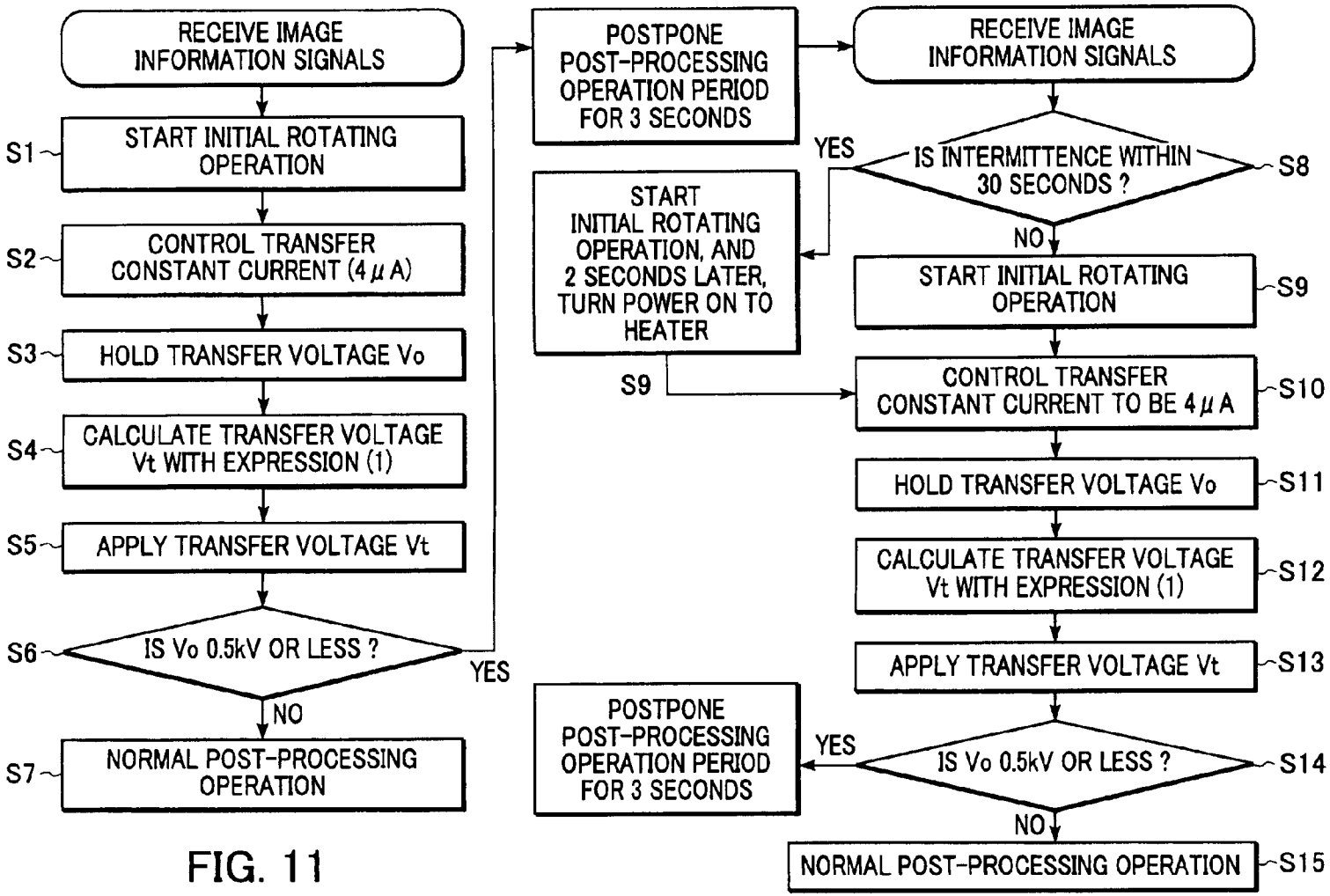
FIG. 11 is a flowchart of anti-slip control according to a third embodiment.

A flowchart for anti-slip control according to a third embodiment is shown in FIG. 11. With the third embodiment, an H/H environment is detected by the transfer roller 6, the image forming operation and the post-processing are performed in this order, and the next image information signals are input within 30 seconds after the post-processing operation is completed. In this case, the initial rotating operation starts, but the timing to turn on the heater 22 is delayed, thereby preventing the pressure roller 24 from being excessively warmed. Details of the flowchart will be described below.

In FIG. 11, all steps excluding Step S9 are the same as those in the second embodiment. In the event of the transfer voltage Vo held in the CPU 27 being 0.5 kV or less, and also in the event of the next printing signals being received within 30 seconds after the post-processing operation being completed, the initial rotating operation starts as usual, but the heater 22 is turned on with a delay of 2 seconds in Step S9. In other words, the rotating operation of the pressure roller 24 is only performed while the heater 22 is still off. Thus, the total period required for the standby operation is extended by 2 seconds. The flow then proceeds to the next Step S10. Step S10 and the following steps are the same printing operations as those described in the second embodiment. In the event of a intermittence period of 30 seconds or more, the initial rotating operation and the operation of turning on the power to the heater 22 are simultaneously performed as with the second embodiment in Step S9.

With the above-described control method, in the event of continuously performing intermittent sheet feeding within 30 seconds in an H/H environment, increasing the idle period of the pressure roller 24 by delaying power supply to the heater 22 prevents the surface temperature of the pressure roller 24 from excessively rising, thereby preventing transporting force which the pressure roller 24 provides to the sheets P from decreasing, consequently preventing slipping from occurring. Not only simply extending the standby period as with the second embodiment but also increasing the idle period of the pressure roller 24 enables the pressure roller 24 to be cooled down in a shorter period.

Now, how slipping occurs according to changes in the surface temperature of the pressure roller 24 during intermittent printing has been confirmed with the same laser beam printer 100 as that in the first and second embodiments, in the second and third embodiments. In the third embodiment, intermittent sheet feeding within 15 seconds, which is the most severe conditions for the tendency to cause the surface temperature of the pressure roller 24 to rise, is performed for 100 sheets as with the second embodiment.

The measurement results of cold-starting and the measurement results of hot-starting generally match those of the second embodiment.

As described above, in the event that intermittent printing with an arrangement wherein the next image information signals are input to the image processing control unit 102 from the external device immediately after the post-processing operation being completed in an H/H environment (intermittent printing within 15 seconds in the third embodiment) is continuously performed, and the pressure roller 24 is sufficiently warmed owing to heat during intermittent printing, extending the period required for the post-processing operation and further increasing the idle period of the pressure roller 24 by delaying the power supply timing to the heater 22, prevents the surface temperature of the pressure roller 24 from excessively rising, thereby preventing the transporting force which the pressure roller 24 provides onto the sheet P from decreasing, consequently preventing slipping from occurring. Not only simply extending a standby period but also increasing an idling period of the pressure roller 24 enable the pressure roller 24 to be cooled down in a shorter period.

Here, with the third embodiment, while power supply to the heater 22 starts 2 seconds after starting the initial rotating operation, this can be appropriately changed depending on the performance of the laser beam printer 100 such as printing speed, controlled temperature, and so forth.

Fourth Embodiment

In addition to the control method of the third embodiment, the fourth embodiment includes an arrangement wherein, following the image forming operation of all pages according to the previous input image information signals being completed, the set temperature of the heater 22 is decreased by 10° C. for only the first sheet of intermittent printing of the next image information signals input within 30 seconds after the post-processing operation being completed. More specifically, in Step S8 in the third embodiment, upon confirming that the next image information signals have been input within 30 seconds after the post-processing operation according to the previous printing having been completed, power supply timing to the heater 22 is delayed by 12 seconds in the following Step S9, and also the control temperature of the heater 22 is reduced by 10° C. as compared with the normal temperature. The control temperature in the normal mode according to the fourth embodiment is set to 170° C., so that the control temperature is 160° C. in the this case. Moreover, in the event of performing continuous sheet feeding from the second sheet, the normal control temperature, that is, the control temperature of 170° C., is set.

With the above-described control method, in the event of continuously performing intermittent sheet feeding within 30 seconds in an H/H environment, delaying the power supply timing to the heater by 12 seconds and further decreasing control temperature of the first sheet by 10° C. compared with normal control temperature not only prevents the temperature of the pressure roller 24 from excessively rising but also maintains the temperature of the pressure roller 24 so as to provide maximal transporting force which the pressure roller 24 provides to the sheets P, thereby constantly providing a stable image regardless of the environment in which the laser beam printer 100 is situated and the operation state of the laser beam printer 100.

Now, how slipping occurs according to changes in the surface temperature of the pressure roller 24 during intermittent printing has been confirmed with the same laser beam printer 100 as that in the first through third embodiments, in the third and fourth embodiments. In the fourth embodiment, intermittent sheet feeding within 15 seconds, which is the most severe conditions for the tendency to cause the surface temperature of the pressure roller 24 to rise, is performed for 100 sheets as with the third embodiment.

Figure 12:
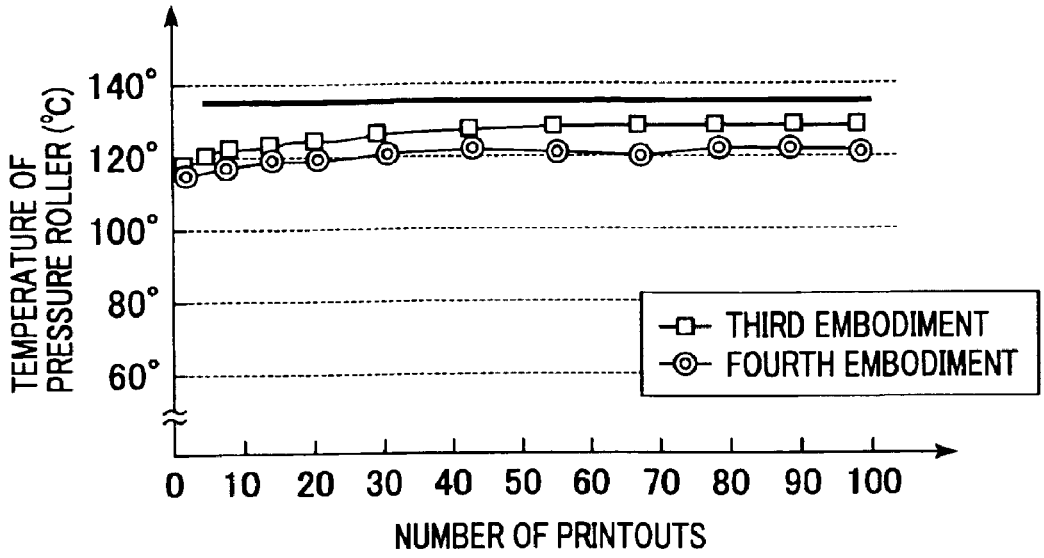
FIG. 12 shows results of a hot-start according to the fourth embodiment.
Figure 13:
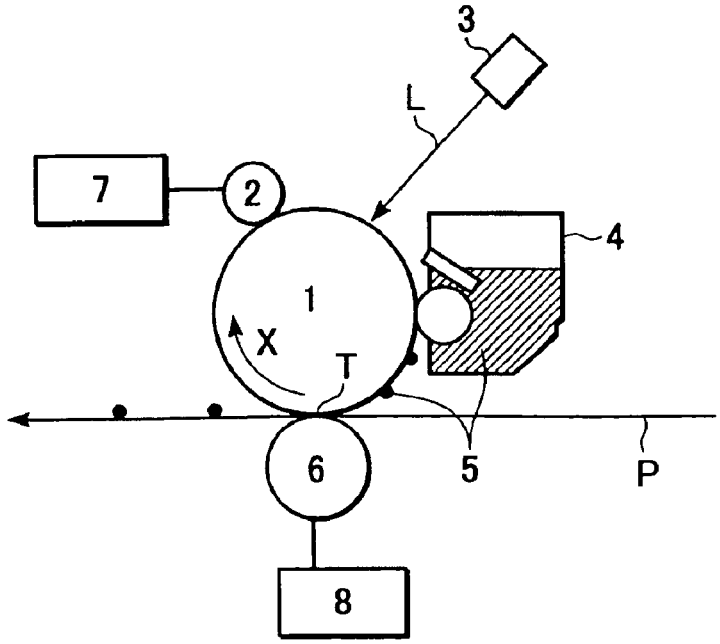
FIG. 13 is a schematic configuration diagram of a laser beam printer.

The measurement results of hot-starting are shown in FIG. 12. According to FIG. 12, the third embodiment is advantageous in that slipping does not occur, and the surface temperature of the pressure roller 24 is maintained around 130° C. However, the pressure roller having the transporting force such as shown in FIG. 4 has been employed in the fourth embodiment, and according to FIG. 4, the temperature of the pressure roller 24 to provide the maximal transporting force is around 122° C. As can be seen from the results in FIG. 12 in the fourth embodiment, the surface temperature of the pressure roller 24 stabilizes at around the temperature in which transporting force constantly becomes maximal during sheet feeding. Thus, the constantly stable transporting force not only prevents slipping from occurring but also prevents skewing and blurring.

As described above, in the event that intermittent printing with an arrangement wherein the next image information signals are input to the image processing control unit 102 from the external device immediately after the post-processing operation being completed in an H/H environment (intermittent printing within 30 seconds in the fourth embodiment) is continuously performed, and the pressure roller 24 is sufficiently warmed owing to heat during intermittent printing, delaying the power supply timing to the heater by 12 seconds and further decreasing the control temperature of the next first sheet by 10° C. as compared with normal control temperature not only prevents the surface temperature of the pressure roller 24 from excessively rising but also maintains the temperature in which the transporting force of the pressure roller 24 constantly becomes maximal, thereby constantly providing a stable image without skewing or blurring, regardless of the environment under which the laser beam printer 100 is situated and the operation state of the laser beam printer 100. Note that with the fourth embodiment, while the control temperature of the first sheet is decreased by 10° C., this can be appropriately changed depending on the performance of the laser beam printer 100 such as printing speed, controlled temperature, and so forth.

With the first through fourth embodiments, the printer control unit 101 extends the period required for the post-processing operation so as to reduce the temperature of the pressure roller 24, and then stops power supply to the heater 22 in the post-processing operation. The same effect can be obtained with an arrangement wherein the printer control unit 101 reduces power to the heater 22 during the post-processing operation compared with power to the heater 22 during the fixing operation instead of stopping the heater 22.

Alternatively, the same effect can be obtained with an arrangement wherein the printer control unit 101 controls the heater 22 to maintain a predetermined temperature, and reduces the temperature maintained by the heater 22 during the post-processing operation compared with the temperature maintained by the heater 22 during the fixing operation.

Alternatively, with the first through fourth embodiments, while the transfer voltage Vo which is applied to the transfer roller by the transfer high-voltage generator 8 so that the transfer current value becomes 4 μA is employed, another method may be employed for determination. For example, an arrangement may be made wherein a switch to be pressed by the user, when the user determines that the environment is an H/H environment, is provided on the laser beam printer 100, and the printer control unit 101 determines the environment depending on whether or not the switch is pressed.

With the fixing device 11 in the first through fourth embodiments, the fixing film 23 is not restricted to a fixing film made of thermostable resin, and a fixing film made of thin metal (metallic sleeve) having flexibility may be used instead.

With the fixing device 11 in the first through fourth embodiments, the heater 22 is not restricted to a heater made of ceramic, for example, a heater made of electromagnetic induction heat-generating member may be used instead. Moreover, the heater 22 is not always disposed at the fixing nip portion. An arrangement may be made wherein the fixing film 23 is externally heated.

Moreover, an arrangement may be made wherein the fixing film itself is configured of an electromagnetic induction heat-generating member, and is heated by exciting means.

Moreover, the pressure rotor of the fixing device 11 is not restricted to a roller, may be a rotating belt.

Moreover, the image carrying member of the image formation apparatus is not restricted to an electrophotography photosensitive drum, and may be an electrostatic recording dielectric member or an intermediate transfer member such as an intermediate transfer drum and a belt and so forth.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

an output unit for outputting information related to the environment in which said image formation apparatus is disposed; and a control unit for providing a predetermined lowering period of temperature for reducing temperature at said fixing unit between a fixing operation for a recording medium on which a developing agent image corresponding to previous image information signals is transferred and a fixing operation for a recording medium on which a developing agent image corresponding to next image information signals has been transferred, wherein said control unit sets said predetermined lowering period of temperature based on information related to said environment which said output unit outputs, and wherein said control unit reduces temperature at said pressure member by stopping heating with said heating member during said predetermined lowering period of temperature.

2. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

an output unit for outputting information related to the environment in which said image formation apparatus is disposed; and a control unit for providing a predetermined lowering period of temperature for reducing temperature at said fixing unit between a fixing operation for a recording medium on which a developing agent image corresponding to previous image information signals is transferred and a fixing operation for a recording medium on which a developing agent image corresponding to next image information signals has been transferred.

wherein said control unit sets said predetermined lowering period of temperature based on information related to said environment which said output unit outputs, and wherein said control unit controls said heating member to maintain a predetermined temperature in said fixing operation, and reduces temperature at said pressure member by controlling said heating member to maintain lower temperature than said predetermined temperature during said predetermined lowering period of temperature.

3. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

an output unit for outputting information related to the environment in which said image formation apparatus is disposed; and a control unit for providing a predetermined lowering period of temperature for reducing temperature at said fixing unit between a fixing operation for a recording medium on which a developing agent image corresponding to previous image information signals is transferred and a fixing operation for a recording medium on which a developing agent image corresponding to next image information signals has been transferred, wherein said control unit sets said predetermined lowering period of temperature based on information related to said environment which said output unit outputs, wherein said information related to the environment is information related to the resistance of said transfer member, wherein said output unit outputs information related to said resistance value based on said transfer voltage which is applied to said transfer member so that a constant current flows into said transfer member, and wherein said control unit sets said predetermined period for a case of said transfer voltage being said predetermined voltage or less, to be longer than said predetermined period for a case of said transfer voltage being greater than said predetermined voltage.

4. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

an output unit for outputting information related to the environment in which said image formation apparatus is disposed; and a control unit for providing a predetermined lowering period of temperature for reducing temperature at said fixing unit between a fixing operation for a recording medium on which a developing agent image corresponding to previous image information signals is transferred and a fixing operation for a recording medium on which a developing agent image corresponding to next image information signals has been transferred, wherein said control unit sets said predetermined lowering period of temperature based on information related to said environment which said output unit outputs, and wherein said control unit sets said predetermined lowering period of temperature by changing a period required for predetermined post-processing operations which said control unit executes following said fixing operations for a recording medium on which a developing agent image corresponding to said previous image information signals is transferred.

5. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

an output unit for outputting information related to the environment in which said image formation apparatus is disposed; and a control unit for providing a predetermined lowering period of temperature for reducing temperature at said fixing unit between a fixing operation for a recording medium on which a developing agent image corresponding to previous image information signals is transferred and a fixing operation for a recording medium on which a developing agent image corresponding to next image information signals has been transferred, wherein said control unit sets said predetermined lowering period of temperature based on information related to said environment which said output unit outputs, and wherein said control unit sets said predetermined lowering period of temperature by changing a period from the end of predetermined post-processing operation which said control unit executes following said fixing operations for a recording medium on which a developing agent image corresponding to said previous image information signals is transferred, to the start of fixing operations for a recording medium on which a developing agent image corresponding to said next image information signal has been transferred.

6. An image formation apparatus according to claim 5, wherein said period until the start of said fixing operation is a period until the start of heating with said heating member.

7. An image formation apparatus comprising:

a charging unit for charging an image carrying member to a predetermined potential;

an exposure unit for exposing said image carrying member in order to form an electrostatic latent image corresponding to image information signals from an external device onto said image carrying member charged by said charging unit;

a developing unit for developing said electrostatic latent image on said image carrying member with a developing agent to form a developing agent image;

a transfer unit for applying a transfer voltage onto a transfer member to transfer said developing agent image on said image carrying member onto a recording medium;

a fixing unit comprising a heating member for thermally fixing said developing agent image onto said recording medium on which said developing agent image is transferred by said transfer unit, and a pressure member for transporting said recording medium while pressing said recording medium against said heating member;

a detecting unit for detecting said transfer voltage applied to said transfer member so that a constant current flows into said transfer member; and a control unit for providing a predetermined lowering period of temperature for reducing temperature at said pressure member between fixing operations for a recording medium on which a developing agent image corresponding to previous image information signals is transferred and fixing operation for a recording medium on which a developing agent image corresponding to next image information signals has been transferred, wherein said control unit sets said predetermined lowering period of temperature for a case of said transfer voltage detected by said detecting unit being said predetermined voltage or less, so as to be longer than said predetermined lowering period of temperature for a case of said transfer voltage being greater than said predetermined voltage.

8. An image formation apparatus according to claim 7, wherein said control unit lowers temperature at said pressure member by stopping heating with a heating member during said predetermined lowering period of temperature.

9. An image formation apparatus according to claim 7, wherein said control unit controls said heating member to maintain a predetermined temperature during said fixing operation, and lowers temperature at said pressure member by controlling said heating member of said fixing unit to maintain lower temperature than said predetermined temperature during said predetermined lowering period of temperature.

10. An image formation apparatus according to claim 7, wherein said control unit sets said predetermined lowering period of temperature by changing a period required for predetermined post-processing operation which said control unit executes following said fixing operation for a recording medium on which a developing agent image corresponding to said previous image information signals is transferred.

11. An image formation apparatus according to claim 7, wherein said control unit sets said predetermined lowering period of temperature by changing a period from the end of predetermined post-processing operations which said control unit executes following said fixing operation for a recording medium on which a developing agent image corresponding to said previous image information signals is transferred, to the start of fixing operations for a recording medium on which a developing agent image corresponding to said next image information signals.

12. An image formation apparatus according to claim 11, wherein said period until the start of said fixing operation is a period until the start of heating with said heating member.

13. An image formation apparatus according to claim 7, wherein said control unit controls said heating member to maintain a predetermined temperature during said fixing operation, and also changes said predetermined temperature based on said transfer voltage detected by said detecting unit.

14. An image formation apparatus according to claim 7, said heating member comprising:

a film member which rotates while being in contact with a recording member; and a heater member for heating a developing agent image on said recording member through said film member.

* * * * *

UNITED STATES PATENT AND TRADEMARK OFFICE

CERTIFICATE OF CORRECTION

PATENT NO. : 7,031,624 B2
APPLICATION NO. : 10/687734
DATED : April 18, 2006
INVENTOR(S) : Shinsuke Kobayashi et al.

It is certified that error appears in the above-identified patent and that said Letters Patent is hereby corrected as shown below:

COLUMN 2:
Line 16, "later" should read --latter--.

COLUMN 13:
Line 10, "a" should read --an--.

COLUMN 14:
Line 15, "the" (1st occurrence) should be deleted.

COLUMN 15:
Line 46, "ceramic," should read --ceramic;--.
Line 56, "may" should read --and may--.

Signed and Sealed this

Twenty-eighth Day of November, 2006

JON W. DUDAS
*Director of the United States Patent and Trademark Office*